US007712256B2

(12) United States Patent
Kato et al.

(10) Patent No.: US 7,712,256 B2
(45) Date of Patent: May 11, 2010

(54) OPENING AND CLOSING APPARATUS

(75) Inventors: Manabu Kato, Hamamatsu (JP); Masaaki Shimizu, Toyohashi (JP)

(73) Assignee: ASMO Co., Ltd., Shizuoka-Ken (JP)

( * ) Notice: Subject to any disclaimer, the term of this patent is extended or adjusted under 35 U.S.C. 154(b) by 625 days.

(21) Appl. No.: 11/602,608

(22) Filed: Nov. 21, 2006

(65) Prior Publication Data

US 2007/0113481 A1 May 24, 2007

(30) Foreign Application Priority Data

Nov. 24, 2005 (JP) ..... 2005-339086

(51) Int. Cl.
*E05F 15/02* (2006.01)

(52) U.S. Cl. ..... 49/26; 49/360; 200/61.43

(58) Field of Classification Search ..... 49/25, 49/26, 27, 360; 200/61.43
See application file for complete search history.

(56) References Cited

U.S. PATENT DOCUMENTS

| | | | | |
|---|---|---|---|---|
| 6,329,774 | B1 * | 12/2001 | Ariav | 318/282 |
| 7,323,885 | B2 * | 1/2008 | Gutendorf | 324/663 |
| 7,518,327 | B2 * | 4/2009 | Newman et al. | 318/286 |
| 2005/0179415 | A1 * | 8/2005 | Nakano et al. | 318/478 |
| 2006/0186900 | A1 * | 8/2006 | Shoji et al. | 324/679 |

FOREIGN PATENT DOCUMENTS

| | | |
|---|---|---|
| JP | 2004-257788 | 9/2004 |

* cited by examiner

*Primary Examiner*—Katherine W Mitchell
*Assistant Examiner*—Daniel Cahn
(74) *Attorney, Agent, or Firm*—Patterson, Thuente, Skaar & Christensen, P.A.

(57) ABSTRACT

An opening and closing apparatus is provided with a foreign material detecting sensor, a position detecting apparatus and a control circuit apparatus. The foreign material detecting sensor has a sensor electrode, and is arranged in a front end of a door panel. The foreign material detecting sensor outputs an electrostatic capacity detection signal corresponding to a change of an electrostatic capacity between the sensor electrode and a foreign material coming close to the electrode. The position detecting apparatus outputs a position detection signal corresponding to a position of the door panel. The control circuit apparatus compares a change amount of the electrostatic capacity detected on the basis of the electrostatic capacity detection signal with a threshold value so as to judge, on the basis of a result of comparison, whether or not a foreign material exists between the door panel and a vehicle body. The control circuit apparatus changes the threshold value on the basis of the position detection signal, in the case of detecting, on the basis of the position detection signal, that the door panel is arranged at the first door position, during a closing motion of the door panel.

11 Claims, 11 Drawing Sheets

Front
Rear
2d
41
2b
2c
Threshold Value
Fully closed
Fully open
A4
A8
A7
A6
A5
Pc
P3
P7
P6
P5
Po
Position of Door

OPENING AND CLOSING APPARATUS

BACKGROUND OF THE INVENTION

The present invention relates to an opening and closing apparatus.

Conventionally, there has been a vehicle provided with an opening and closing apparatus structured such as to slide a door panel along the fore-and-aft direction of the vehicle by a driving force of a motor so as to open and close a door of the vehicle. The opening and closing apparatus is provided with a detecting sensor for detecting an existence of a foreign material between the door panel under a closing motion and a vehicle body.

For example, a detecting sensor described in Japanese Laid-Open Patent Publication No. 2004-257788 is provided with a sensor electrode for detecting a foreign material between a door panel and a vehicle body on the basis of a change of an electrostatic capacity. The sensor electrode is arranged in a front end of the door panel. Further, if a foreign material exists between the door panel and the vehicle body during the closing motion of the door panel, the electrostatic capacity in the sensor electrode is changed, and the change of the electrostatic capacity is output as a signal voltage to a control apparatus. The control apparatus compares an input voltage signal with a predetermined threshold value. In the case that the signal voltage is over the predetermined threshold value, the control apparatus determines that a foreign material exists between the door panel and the vehicle body, and moves the door panel to a full-open position on the basis of the driving force of the motor. As mentioned above, the detecting sensor described in Japanese Laid-Open Patent Publication No. 2004-257788 detects a foreign material existing between the door panel and the vehicle body in a non-contact manner.

If the door panel during the closing motion comes close to a full-close position, a front end of the door panel comes close to a front door and a center pillar (a B pillar). Since the front end of the door panel comes close to the front door and the center pillar, whereby the electrostatic capacity in the sensor electrode is changed, there is a risk that the signal voltage gets over the predetermined threshold value and the existence of a foreign material is erroneously detected. Accordingly, in the detecting sensor described in Japanese Laid-Open Patent Publication No. 2004-257788, if the door panel is arranged at a position spaced at a predetermined distance to the full-close position of the door panel, a control apparatus cancels a function of detecting a foreign material in the non-contact manner, whereby an erroneous detection of the existence of a foreign material is prevented. Further, when the door panel slides in a range from the position spaced at the predetermined distance to the full-close position of the door panel to the full-close position, the detecting sensor detects the contact between the door panel and a foreign material, thereby detecting a foreign material between the door panel and the vehicle body.

However, in the case that the function of detecting a foreign material between the door panel and the vehicle body in the non-contact manner is cancelled, when the door panel slides in the range from the position spaced at the predetermined distance to the full-close position of the door panel to the full-close position, a foreign material existing between the door panel and the vehicle body is detected first at a time when the door panel is brought into contact with a foreign material. Accordingly, there is a risk that a foreign material is wedged between the vehicle body and the door panel and a great load is applied to the foreign material, while the door panel is stopped or is moved toward the full-open position after the door panel is brought into contact with the foreign material. Therefore, it is desirable that a foreign material existing between the door panel and the vehicle body be detected in the non-contact manner as much as possible. In other words, it is desirable to widen the range in which a foreign material existing between the door panel and the vehicle body is detected in the non-contact manner, within the moving range of the door panel.

Further, since the shapes of the front door and the center pillar vary in correspondence to vehicle types, a degree of the change of the electrostatic capacity in the sensor electrode at a time when the front end of the door panel comes close to the front door and the center pillar is different in correspondence to the vehicle type. Accordingly, in order to widen the range for detecting a foreign material existing between the door panel and the vehicle body in the non-contact manner, it is desirable to execute the erroneous detection prevention of the existence of a foreign material caused when the front end of the door panel comes close to the front door and the center pillar, in correspondence to the vehicle type.

SUMMARY OF THE INVENTION

An object of the preset invention is to provide an opening and closing apparatus which can execute an erroneous detection prevention of a foreign material in correspondence to the shape of a fixed body such as a vehicle or the like, and widens a range in which a foreign material existing between the fixed body and a movable body can be detected in a non-contact manner within a movable range of the movable body such as a door or the like.

In accordance with one aspect of the present invention, an opening and closing apparatus including a fixed body, an opening portion, a movable body, a detecting sensor, a judging portion, a position detecting portion, a first change position, and a threshold value is provided. The fixed body has conductivity. The opening portion is formed in the fixed body and has a peripheral edge. The movable body is moved between a full-close position closing the opening portion and a full-open position leaving open the opening portion. The detecting sensor has a sensor electrode provided at at least one of an end portion positioned in a front side in a moving direction at a time of a closing motion of the movable body, and a peripheral edge of the opening portion facing the movable body in the moving direction in the movable body. The detecting sensor outputs an electrostatic capacity detection signal in correspondence to a change of an electrostatic capacity between the sensor electrode and a conductive foreign material moving close to the sensor electrode. The judging portion has a threshold value for judging whether or not a foreign material exists between the movable body and the peripheral edge of the opening portion, compares the threshold value with a detection value on the basis of the electrostatic capacity detection signal, and judges, on the basis of a result of comparison, whether or not a foreign material exists between the movable body and the peripheral edge of the opening portion. The position detecting portion outputs a position detection signal corresponding to a position of the movable body. The first change position is previously set between the full-open position and the full-close position. The threshold value change portion changes the threshold value on the basis of the position detection signal in the case of detecting, on the basis of the position detection signal, that the movable body is arranged at the first change position during a closing motion of the movable body.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 5(*b*) is a cross sectional view showing a sensor main body;

DETAILED DESCRIPTION OF THE PREFERRED EMBODIMENTS

Figure 1:
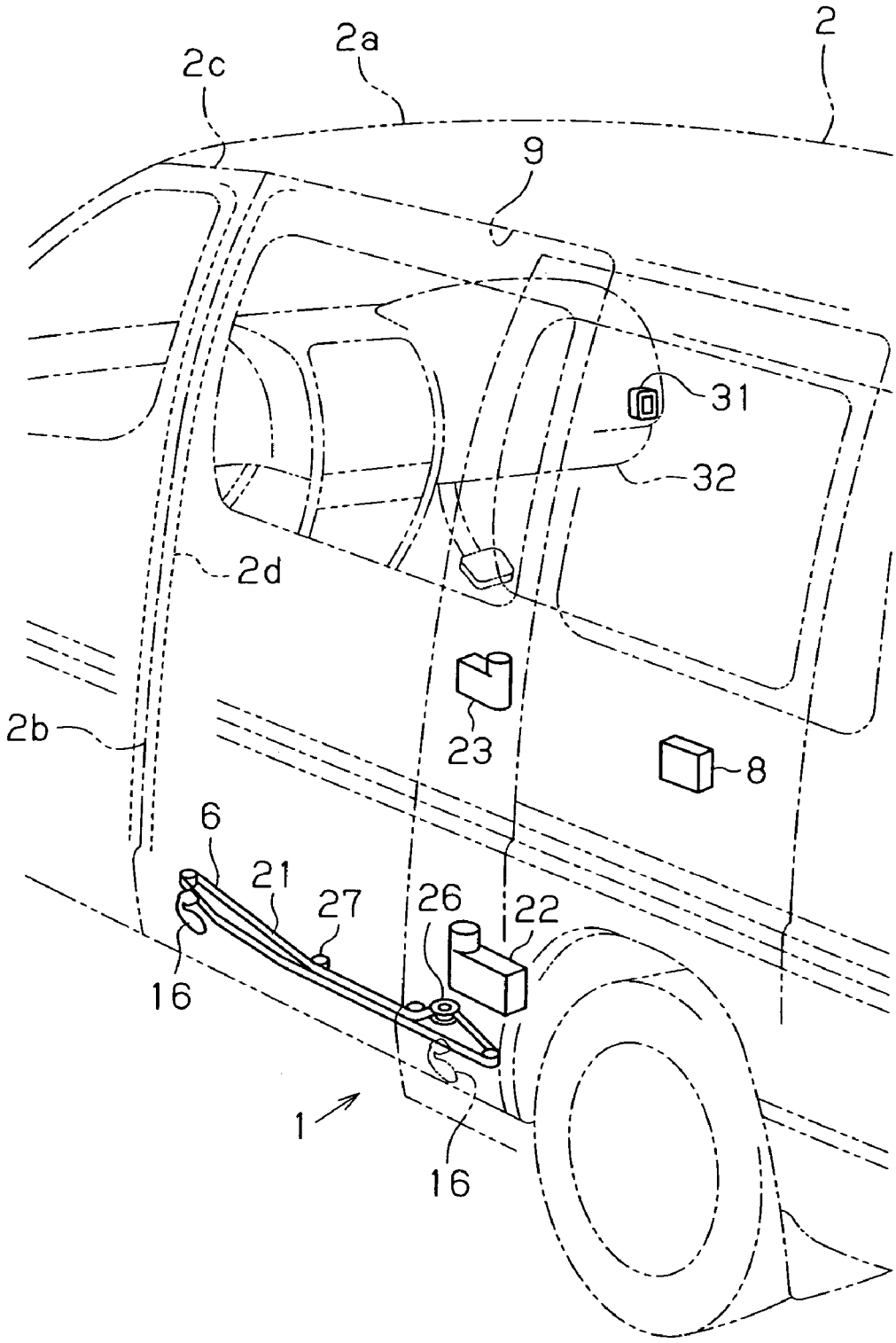
FIG. 1 is a perspective view showing a motor-driven slide door apparatus in accordance with an embodiment.
Figure 2:
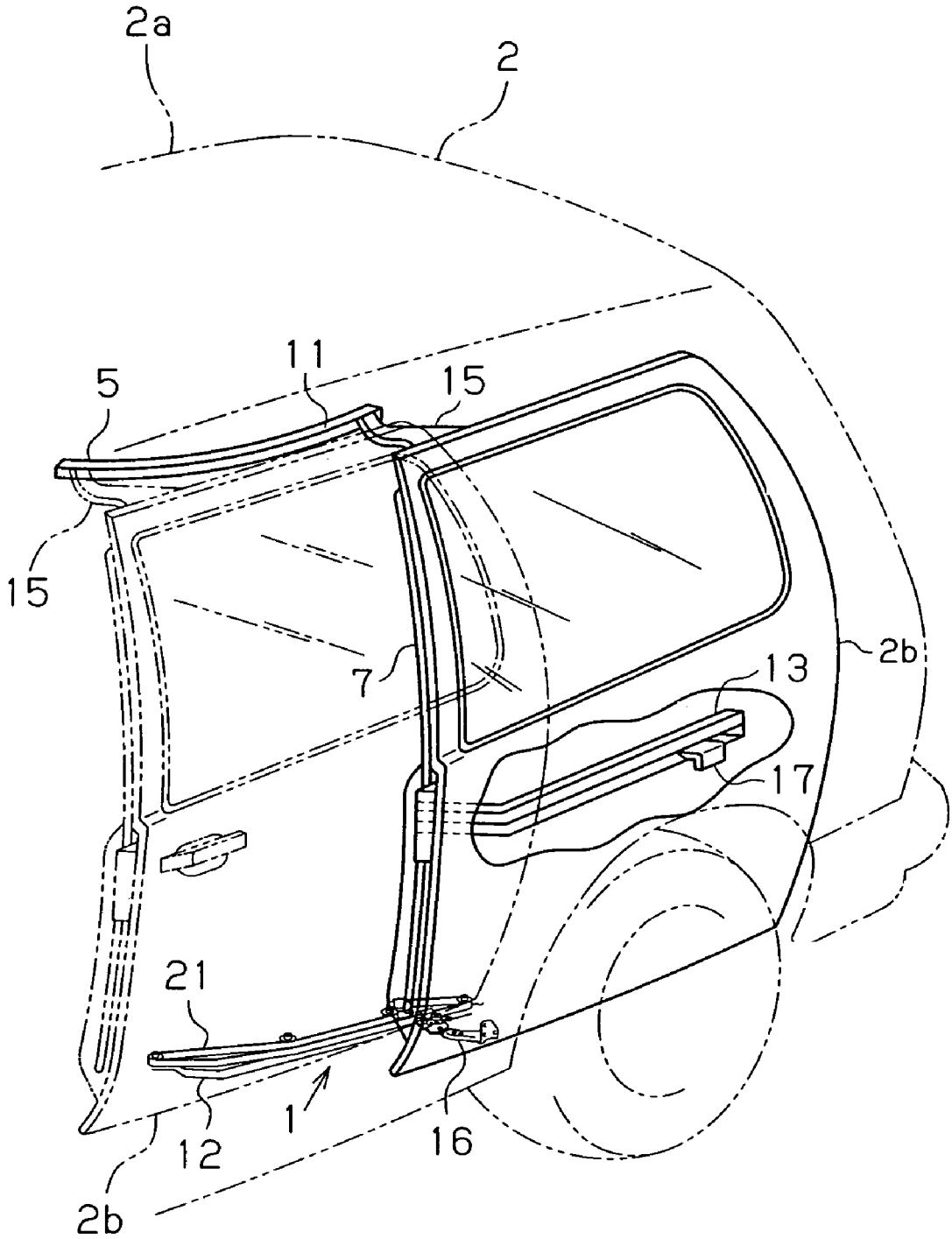
FIG. 2 is a perspective view showing the motor-driven slide door apparatus.

A description will be given below of an embodiment obtained by embodying the present invention to a motor-driven slide door apparatus mounted on a vehicle in accordance with the accompanying drawings. FIGS. 1 and 2 are perspective views showing a motor-driven slide door apparatus 1 (an opening and closing apparatus) serving as an opening and closing apparatus in accordance with the present embodiment. As shown in FIGS. 1 and 2, the motor-driven slide door apparatus 1 is mounted on a vehicle 2, and is provided with a vehicle body 2*a* serving as a fixed body and a body of a vehicle, a door panel 2*b* serving as a movable body, an actuating mechanism 5, a driving mechanism 6, a foreign material detecting portion 7, and a control circuit apparatus 8. The control circuit apparatus 8 serves as a judging portion and a threshold value changing portion.

The vehicle body 2*a* and the door panel 2*b* are formed by a metal having conductivity. A door opening 9 serving as an opening portion having a quadrangular shape is formed in a left side surface of the vehicle body 2*a*. The door opening 9 is opened and closed by the door panel 2*b* having a quadrangular shape corresponding to the door opening 9. A door panel 2*c* facing a front passenger seat is provided in a front side of the door opening 9. A center pillar 2*d* having a conductivity extends along upper and lower sides of the vehicle 2, within the vehicle near a boundary between the door panel 2*c* and the door panel 2*b* arranged at a full-close position.

The door panel 2*b* is attached so as to be movable along the fore-and-aft direction of the vehicle body 2*a* by the actuating mechanism 5, for opening and closing the door opening 9. A lock mechanism (not shown), for example, a latch is provided in the door panel 2*b*. The lock mechanism fixes the door panel 2*b* so as to be immovable with respect to the vehicle body 2*a*, in a state in which the door panel 2*b* closes the door opening 9, that is, in a state in which the door panel 2*b* is arranged at the full-close position. A half latch detecting portion (not shown) is provided in the lock mechanism. The half latch detecting portion outputs a half latch detection signal to the control circuit apparatus 8, if the lock mechanism is in a half latch state.

The actuating mechanism 5 is constituted by an upper rail 11, a lower rail 12 and a center rail 13 provided in the vehicle body 2*a*, and an upper arm 15, a lower arm 16 and a center arm 17 provided in the door panel 2*b*.

The upper rail 11 and the lower rail 12 are respectively provided in an upper portion and a lower portion of the door opening 9 in the vehicle 2, and extend along fore-and-aft direction of the vehicle 2. The center rail 13 is provided in an approximately center portion of a portion positioned in a rear side of the door opening 9 in the vehicle 2, and extends along fore-and-aft direction of the vehicle 2. Each of the rails 11 to 13 is formed in such a manner as to extend along fore-and-aft direction of the vehicle 2. A front end portion of each of the rails 11 to 13 is curved toward an inner side of the vehicle.

The arms 15 to 17 are respectively fixed to predetermined positions of an upper portion, a lower portion and a center portion in a side surface facing the inner side of the vehicle of the door panel 2*b*. The upper arm 15 is coupled to the upper rail 11. The lower arm 16 is coupled to the lower rail 12. The center rail 13 is coupled to the center arm 17. The arms 15 to 17 are respectively guided by the rails 11 to 13 so as to be movable along fore-and-aft direction of the vehicle 2.

The driving mechanism 6 is provided with an endless belt 21, a slide actuator 22, a closure actuator 23 and a position detecting apparatus 24 (refer to FIG. 6) serving as a position detecting portion. The driving mechanism 6 is controlled by the control circuit apparatus 8. A drive pulley 26 rotating around a shaft extending along the upper and lower sides of the vehicle 2 and a plurality of driven pulleys 27 are provided in a side portion of the lower rail 12. The endless belt 21 is wound around the drive pulley 26 and the driven pulleys 27. A distal end portion of the lower arm 16 is fixed to the endless belt 21.

The slide actuator 22 is connected to the drive pulley 26. The slide actuator 22 is provided with a slide motor 28 (refer to FIG. 6), and a speed reducing mechanism (not shown) reducing a speed of rotation of the slide motor 28. The slide motor 28 is rotated in correspondence to a drive signal input from the control circuit apparatus 8. The rotation of the slide motor 28 is reduced by the speed reducing mechanism, and is transmitted to the drive pulley 26 from an output shaft (not shown) of the slide actuator 22. Further, if the endless belt 21 is rotated by the rotation of the drive pulley 26, the lower arm 16 moves along the lower rail 12, and the door panel 2*b* is slid forward and backward.

The closure actuator 23 is arranged in an inner portion of the door panel 2*b*. The closure actuator 23 is provided with a closure motor 29 (refer to FIG. 6), and a speed reducing mechanism (not shown) reducing a speed of rotation of the closure motor 29. The closure motor 29 is rotated in correspondence to the drive signal input from the control circuit apparatus 8 so as to actuate the lock mechanism and move the door panel 2*b* to the position where the lock can be achieved by the lock mechanism.

Figure 6:
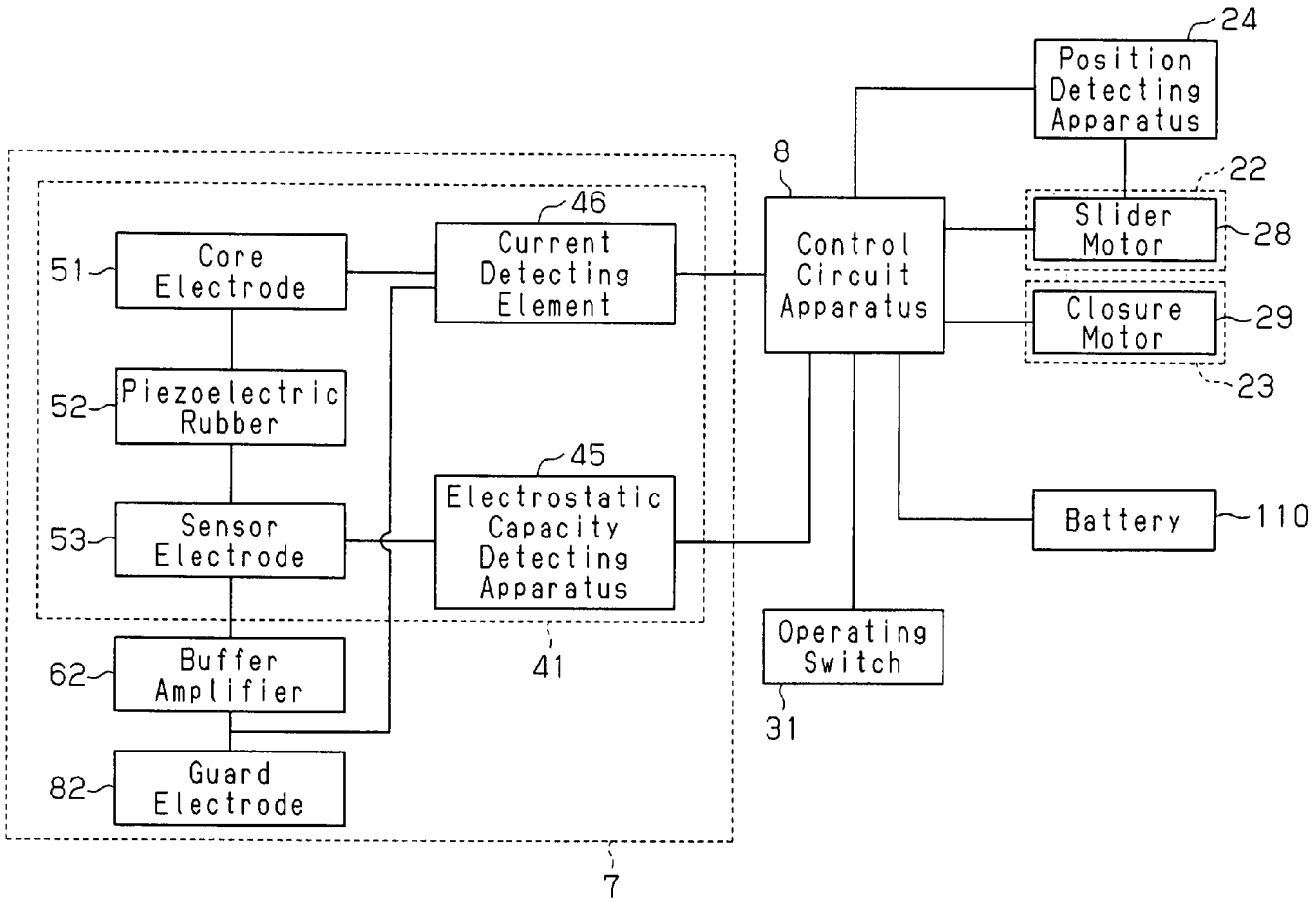
FIG. 6 is a block diagram showing an electric structure of the motor-driven slide door apparatus.

As shown in FIG. 6, the position detecting apparatus 24 is arranged to correspond to one of a rotating shaft (not shown) of the slide motor 28, an output shaft (not shown) of the slide actuator 22, and reducing gears (not shown). The reducing gears are provided between the rotating shaft of the slide motor 28 and the output shaft of the slide actuator 22, and constitute the speed reducing mechanism. The position detecting apparatus 24 detects an amount of rotation of any one of the rotating shaft, the output shaft and the speed reducing gear from a time point when the slide motor 28 starts driving. The position detecting apparatus 24 outputs a position detection signal corresponding to the detected amount of rotation to the control circuit apparatus 8. The position detecting apparatus 24 is constituted, for example, by a permanent magnet rotating together with any one of the rotating shaft, the output shaft and the speed reducing gear, and a Hall element arranged so as to face the permanent magnet, and outputs a pulse signal as a position detection signal.

As shown in FIG. 1, a dash board 32 of the vehicle 2 is provided with an operating switch 31 electrically connected to the control circuit apparatus 8. If the operating switch 31 is operated by a passenger so as to leave open the door opening 9, the operating switch 31 outputs an open signal for sliding the door panel 2*b* so as to leave open the door opening 9 to the control circuit apparatus 8. On the other hand, if the operating switch 31 is operated by the passenger so as to close the door opening 9, the operating switch 31 outputs a close signal for sliding the door panel 2*b* so as to close the door opening 9 to the control circuit apparatus 8.

Figure 3:
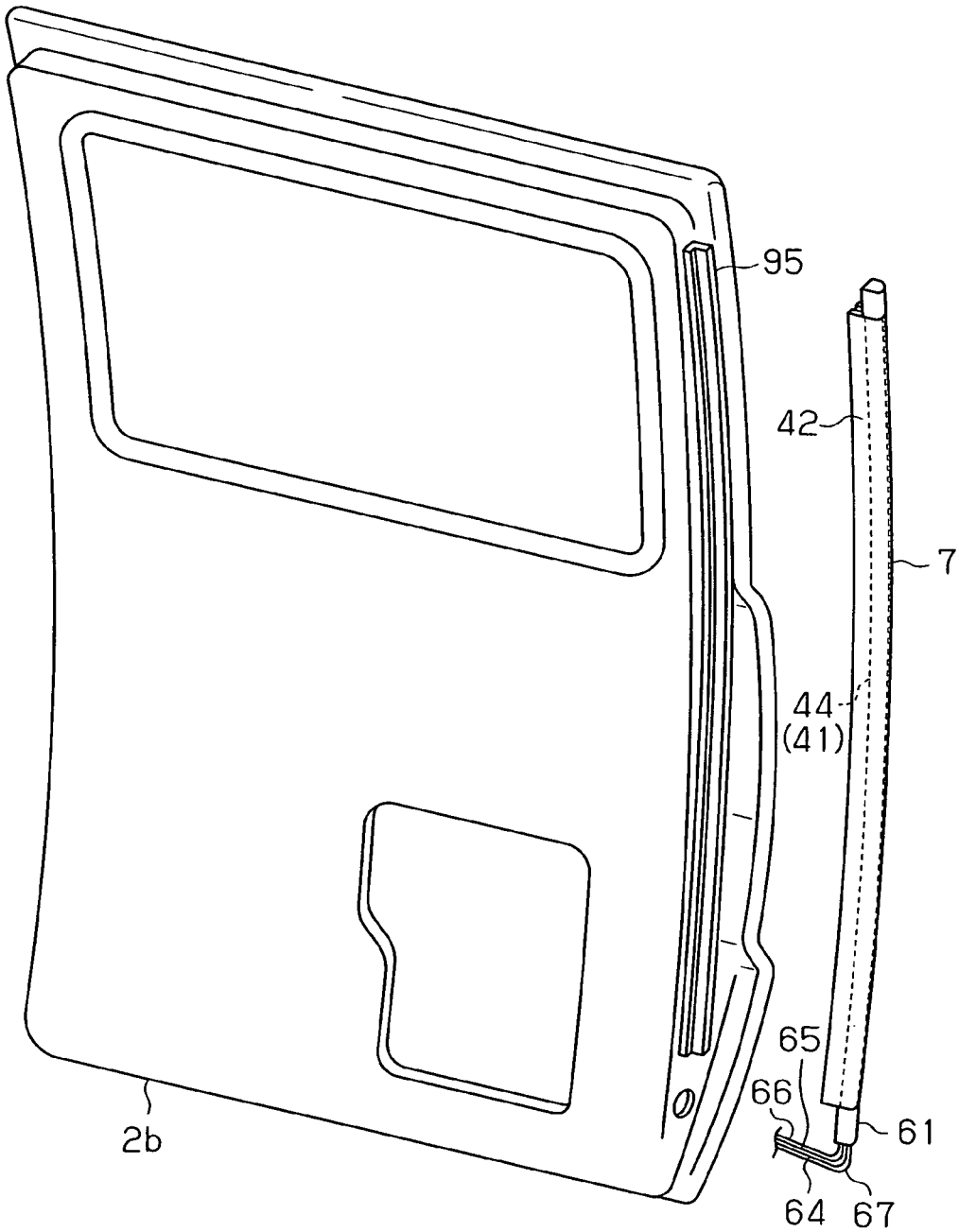
FIG. 3 is a perspective view showing a door panel.

As shown in FIG. 3, the foreign material detecting portion 7 is provided with a foreign material detecting sensor 41 and a protector 42. The foreign material detecting portion 7 detects the existence of a foreign material having a conductivity between the door panel 2*b* and the vehicle body 2*a*, in detail, between a front end of the door panel 2*b* and a peripheral edge (a rear end of the door panel 2*c* in the present embodiment) of the door opening 9 facing the front end, at a time when the door panel 2*b* is slid in a direction of closing the door opening 9.

Figure 5A:
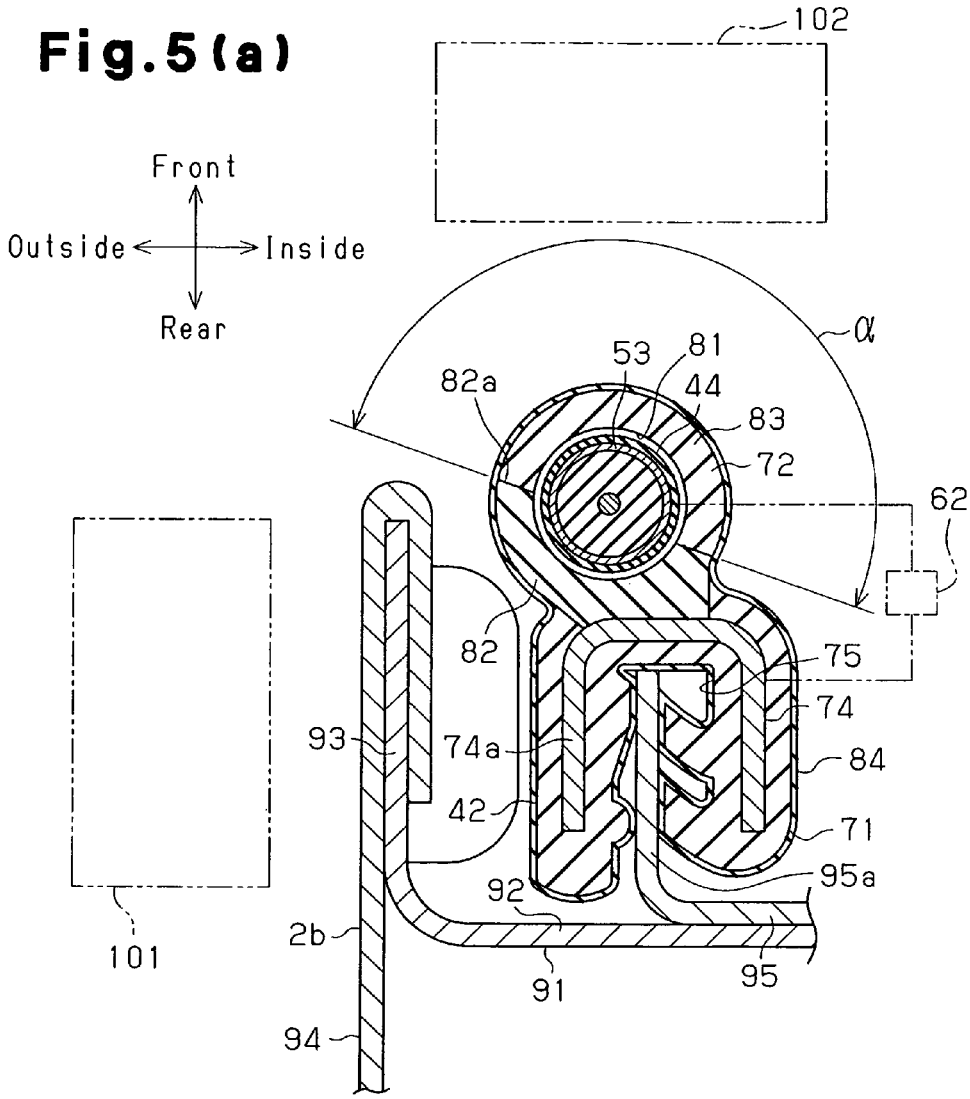
FIG. 5(*a*) is a cross sectional view showing a foreign material detecting sensor.
Figure 5B:
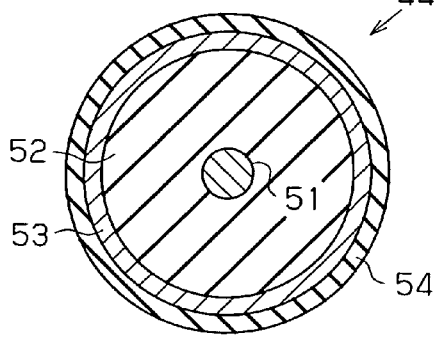

As shown in FIGS. 5(*a*) and 6, the foreign material detecting sensor 41 serving as the detecting sensor is provided with a sensor main body 44, an electrostatic capacity detecting apparatus 45 and a current detecting element 46. As shown in FIG. 5(*a*), the sensor main body 44 is arranged in an end portion positioned in a front side in a forward moving direction at a time of a closing operation of the door panel 2*b*, that is, a front end of the door panel 2*b*. The sensor main body 44 has a coaxial cable shape. In detail, as shown in FIG. 5(*b*), a piezoelectric rubber 52 having a cylindrical shape is provided in an outer periphery of a core electrode 51 having a cylindrical shape so as to be coaxial with the core electrode 51. The piezoelectric rubber 52 has a nature that a value of resistance becomes small and an electric current flows if a pressing force is applied to the piezoelectric rubber 52, and has an insulating property in a state in which the pressing force is not applied. A sensor electrode 53 constituted by a conductor body having a cylindrical shape is provided in an outer periphery of the piezoelectric rubber 52 so as to be coaxial with the core electrode 51. An outer skin 54 having an insulating property and a cylindrical shape is provided in an outer periphery of the sensor electrode 53 so as to be coaxial with the core electrode 51.

As shown in FIG. 3, one end portion (an upper end portion in FIG. 3) of the sensor main body 44 is molded by a resin, and a terminal treatment portion 61 is provided in the other end portion (a lower end portion in FIG. 3) of the sensor main body 44 so as to be integrally formed with the sensor main body 44. The terminal treatment portion 61 electrically connects the sensor main body 44, and the electrostatic capacity detecting apparatus 45 and the current detecting element 46.

Figure 4:
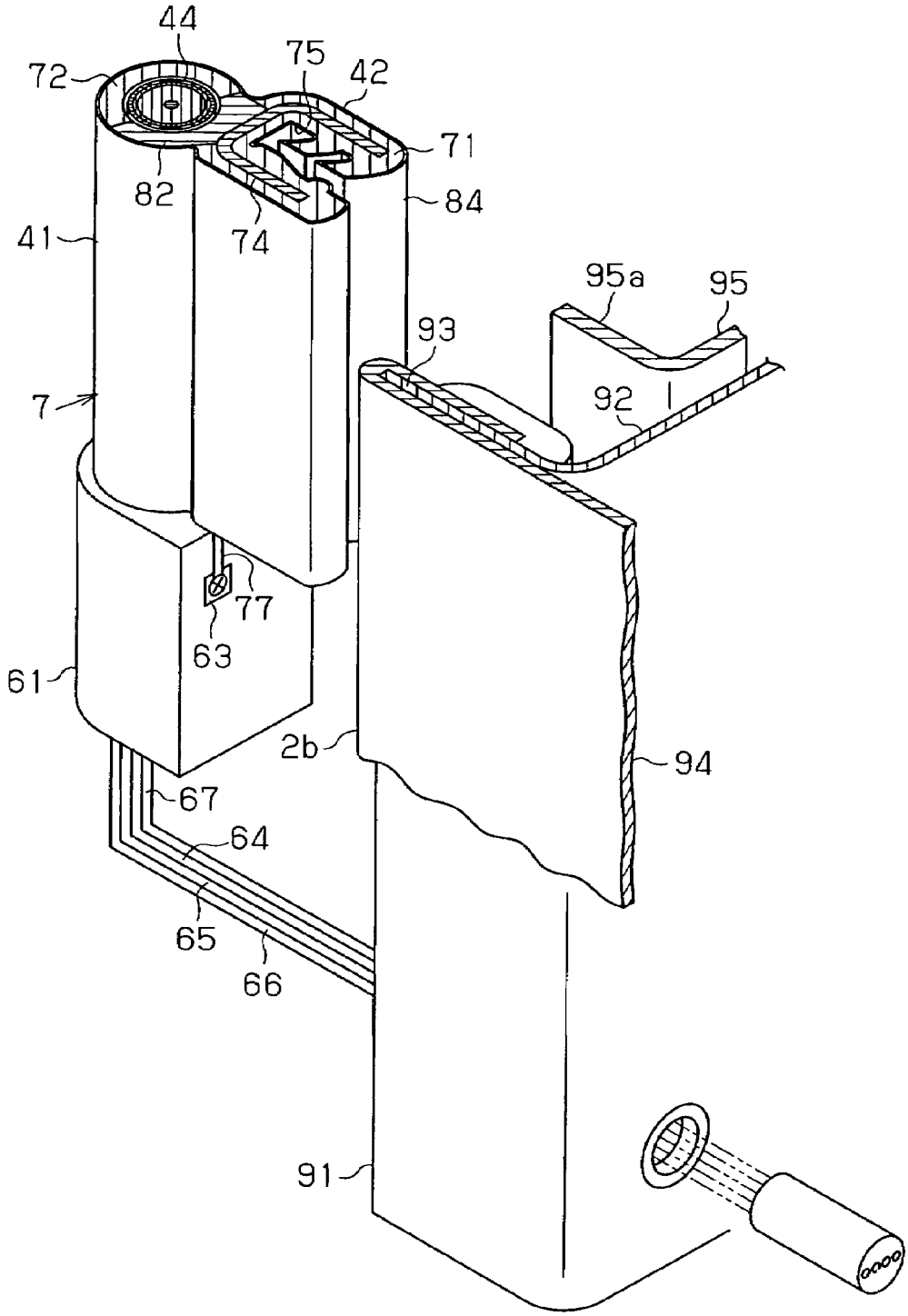
FIG. 4 is a perspective view showing a terminal treatment portion.

As shown in FIGS. 4 and 5(*a*), the terminal treatment portion 61 is structured such that a substrate (not shown) on which a buffer amplifier 62 and a plurality of connecting metal plates (not shown) are arranged is molded by resin together with the sensor main body 44. An input terminal of the buffer amplifier 62 is electrically connected to the sensor electrode 53 via the metal plate. An output terminal of the buffer amplifier 62 is electrically connected to a terminal 63 provided in such a manner as to be exposed to an outer surface of the terminal treatment portion 61. Four lead wires 64 to 67 extend from the terminal treatment portion 61. The lead wire 64 is connected to the buffer amplifier 62 so as to supply a power source to the buffer amplifier 62. The lead wire 65 connects the buffer amplifier 62 and the core electrode 51 to the ground surface. The lead wire 66 electrically connects the sensor electrode 53 to the electrostatic capacity detecting apparatus 45. The lead wire 67 electrically connects the buffer amplifier 62 to the current detecting element 46. The sensor electrode 53 is electrically connected to the current detecting element 46 via the buffer amplifier 62 by the lead wire 67. An electric current is supplied to the sensor electrode 53 via the control circuit apparatus 8.

As shown in FIG. 6, the electrostatic capacity detecting apparatus 45 constitutes an electrostatic capacity type sensor detecting a foreign material existing between the door panel 2*b* and the vehicle body 2*a* in a non-contact manner together with the sensor electrode 53. The electrostatic capacity detecting apparatus 45 is driven by the control circuit apparatus 8. If the electrostatic capacity detecting apparatus 45 detects a change of the electrostatic capacity between the sensor electrode 53 and the ground surface, it outputs the electrostatic capacity detection signal corresponding to an amount of change of the electrostatic capacity in the sensor electrode 53 to the control circuit apparatus 8.

The current detecting element 46 constitutes a contact type sensor which is brought into contact with a foreign material existing between the door panel 2*b* and the vehicle body 2*a* so as to detect a foreign material, together with the core electrode 51, the piezoelectric rubber 52 and the sensor electrode 53. The current detecting element 46 is arranged within the door panel 2*b*, and detects the electric current flowing through a portion between the sensor electrode 53 and the core electrode 51. If the pressing force is applied to the sensor main body 44 from the external portion, that is, if the pressing force is applied to the piezoelectric rubber 52, the value of resistance of the piezoelectric rubber 52 is changed and the electric current flows through the portion between the sensor electrode 53 and the core electrode 51. At this time, the current detecting element 46 outputs a current detection signal indicating that the electric current flows through the portion between the sensor electrode 53 and the core electrode 51 to the control circuit apparatus 8. A structure shown in FIG. 6 and an operation obtained from the structure shown in FIG. 6 correspond to one example, and they may be approximately changed.

As shown in FIG. 5(*a*), the protector 42 holds the sensor main body 44, and fixes the sensor main body 44 to the door panel 2*b*. The protector 42 is provided with a mounting portion 71, and a holding portion 72 integrally formed with the mounting portion 71.

The mounting portion 71 is constituted by a reinforcing member 74 covered by an insulating resin material (including an elastomer and a rubber). The reinforcing member 74 is constituted by a plurality of bone members 74*a* coupled to each other and having a U shape and conductivity. A mounting groove 75 extending in a longitudinal direction of the mounting portion 71 and open toward an opposite side to the holding portion 72 are formed at a portion positioned in an inner side of the bone members 74*a* in the mounting portion 71. The length in a longitudinal direction of the mounting portion 71 is set to be equal to the length in an axial direction of the sensor main body 44 (refer to FIG. 3). An electric wire 77 (refer to FIG. 4) is electrically connected to one end portion of the reinforcing member 74.

The holding portion 72 has a cylindrical shape, and the axial length of the holding portion 72 is set equal to the length of the mounting portion 71 in the longitudinal direction. The inner diameter of an insertion hole 81 formed by an inner peripheral surface of the holding portion 72 is formed slightly larger than an outer diameter of the sensor main body 44. The holding portion 72 mentioned above is constituted by a guard electrode 82 and a contact portion 83.

The guard electrode 82 is formed by elastically deformable conductive resin materials (including the elastomer and the rubber). The guard electrode 82 is integrally formed with an opposite side portion to the opening portion in the mounting portion 71 having the U shape. The guard electrode 82 is brought into contact with the reinforcing member 74. The guard electrode 82 has a circular arc shape open toward the opposite side to the mounting portion 71, in the shape as seen from an axial direction of the holding portion 72.

The contact portion 83 is formed by an elastically deformable insulative resin (including elastomer and rubber). The shape of the contact portion 83 as seen from the axial direction of the holding portion 72 has a circular arc shape open toward the guard electrode 82. The contact portion 83 is integrally formed with the guard electrode 82. In other words, the contact portion 83 and the guard electrode 82 are integrally formed, whereby the holding portion 72 having an approximately cylindrical shape is formed.

An outer peripheral surface of the protector 42 is covered by an insulating coating 84, for example, made of silicon. In a state in which the sensor main body 44 is inserted into the holding portion 72, the protector 42 is fixed to the front end of the door panel 2*b*. In detail, an inner plate 91 constituting the door panel 2*b* has a fixed portion 92 formed in such a manner as to extend along a width of the vehicle in a front end portion (an end portion positioned in a front side of the vehicle 2), and has an extended portion 93 extended toward the front side of the vehicle from an end portion of the fixed portion 92 facing outside of the vehicle. A distal end of the extended portion 93 is covered by an outer plate 94 constituting the door panel 2*b*. A bracket 95 having a bracket main body 95*a* extended toward the front side of the vehicle 2 is fixed to a side surface of the fixed portion 92 facing the front side of the vehicle 2. The bracket 95 extends along upper and lower sides of the vehicle 2. The bracket main body 95*a* is pressure inserted to the mounting groove 75, whereby the protector 42 is fixed to the bracket main body 95*a*, that is, the front end of the door panel 2*b*.

In a state in which the sensor main body 44 is fixed to the door panel 2*b* via the protector 42, the sensor main body 44 protrudes to the front side of the vehicle 2 than a distal end (including the outer plate 94 covering the extended portion 93) of the extended portion 93. Further, the end surface 82*a* of the guard electrode 82, which faces the outside of the vehicle, is positioned in the front side of the vehicle 2 than the distal end of the extended portion 93, and a part of the guard electrode 82 is arranged between the outer plate 94 and the sensor main body 44.

As shown in FIG. 4, in a state in which the sensor main body 44 is accommodated within the holding portion 72, the electric wire 77 provided in the lower end of the reinforcing member 74 is screwed with the terminal 63 of the terminal treatment portion 61 provided in the lower end of the sensor main body 44. Accordingly, as shown in FIG. 5(*a*), the output terminal of the buffer amplifier 62 and the bone member 74*a* are electrically connected, and the output terminal of the buffer amplifier 62 and the guard electrode 82 are electrically connected. Therefore, the sensor electrode 53 and the guard electrode 82 are electrically connected via the buffer amplifier 62. An electric power is supplied to the guard electrode 82 via the sensor electrode 53 and the buffer amplifier 62, and a voltage of the guard electrode 82 is kept at the same value as a voltage of the sensor electrode 53.

If the voltage of the guard electrode 82 is kept at the same value as the voltage of the sensor electrode 53, even in the case that the electrostatic capacity between the guard electrode 82 and a foreign material 101 is changed by the foreign material 101 coming close to the sensor electrode 53 from a side opposite to the guard electrode 82, the change of the electrostatic capacity does not affect the amount of change of the electrostatic capacity detected by the sensor electrode 53. Accordingly, a portion facing the guard electrode 82 in the sensor electrode 53 comes to a dead zone. On the contrary, a portion which does not face the guard electrode 82 in the sensor electrode 53, that is, a portion facing the contact portion 83 in the sensor electrode 53 has a detection range a capable of detecting the change of the electrostatic capacity due to the approach of a foreign material 102.

As shown in FIGS. 1 and 6, the control circuit apparatus 8 is arranged in the inner portion of the door panel 2*b*. An electric power is supplied to the control circuit apparatus 8 from a battery 110 of the vehicle 2. The control circuit apparatus 8 outputs various drive signals for controlling the slide actuator 22 and the closure actuator 23 in correspondence to various signals input from the half latch detecting portion, the position detecting apparatus 24, the operating switch 31, the electrostatic capacity detecting apparatus 45 and the current detecting element 46. Further, the control circuit apparatus 8 detects a slide amount of the door panel 2*b*, that is, a position of the door panel 2*b* on the basis of the position detection signal input from the position detecting apparatus 24.

If the current detection signal is input to the control circuit apparatus 8 from the current detecting element 46 during the closing motion of the door panel 2*b*, the control circuit apparatus 8 determines on the basis of the input of the current diction signal that a foreign material exists between the door panel 2*b* and the vehicle body 2*a*. Further, the control circuit apparatus 8 outputs to the slide motor 28 the drive signal for moving the door panel 2*b* to the full-open position.

The control circuit apparatus 8 has a threshold value for judging on the basis of the electrostatic capacity detection signal whether or not a foreign material exists between the door panel 2*b* and the vehicle body 2*a*. If the electrostatic capacity detection signal is input to the control circuit apparatus 8 from the electrostatic capacity detecting apparatus 45, the control circuit apparatus 8 detects a change amount (a detection value) of the electrostatic capacity in the sensor electrode 53 on the basis of the input electrostatic capacity detection signal. In the case that the detected change amount of the electrostatic capacity is larger than the threshold value as a result of comparison between the detected change amount of the electrostatic capacity and the threshold value, the control circuit apparatus 8 determines that a foreign material exists between the door panel 2*b* and the vehicle body 2*a*. Further, the control circuit apparatus 8 outputs to the slide motor 28 the drive signal for moving the door panel 2*b* to the full-open position.

Figure 7:
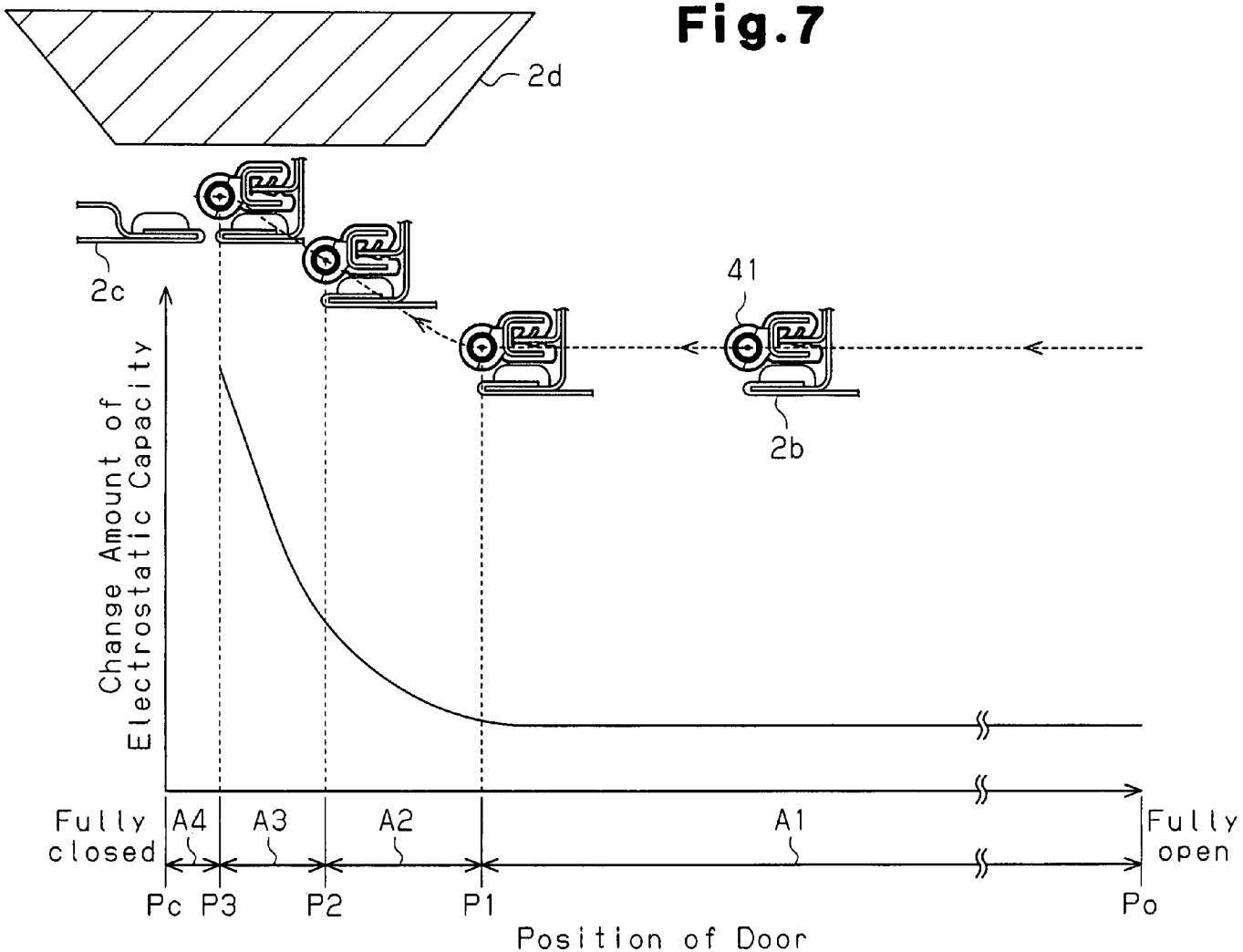
FIG. 7 is a graph showing a relation between a position of a door panel, and a change amount of an electrostatic capacity between a vehicle body and a sensor electrode.

FIG. 7 shows a relation between the position of the door panel 2*b* during the closing motion, and the change amount of the electrostatic capacity actually detected by the sensor electrode 53, in the case that no foreign material exists between the door panel 2*b* and the vehicle body 2*a*. FIG. 7 shows that the change amount of the electrostatic capacity in the sensor electrode 53 has a characteristic that if the door panel 2*b* passes a predetermined position, the change amount of the electrostatic capacity becomes larger in a curved manner while increasing a change rate step by step in proportion to coming close to the full-close position Pc. The change amount of the electrostatic capacity in the sensor electrode 53 is changed as shown in FIG. 7, because the front end of the door panel 2*b* comes close to the rear end of the door panel 2*c* and the center pillar 2*d* as the door panel 2*b* comes close to the full-close position Pc, whereby the electrostatic capacity becomes larger in the portion between the sensor electrode 53, and the rear end of the door panel 2*c* and the center pillar 2*d*. Accordingly, the control circuit apparatus 8 in accordance with the present embodiment changes the threshold value in correspondence to the position of the door panel 2*b*, by changing the change rate of the threshold value in correspondence to the position of the door panel 2*b*, as shown in FIG. 8.

A first door position P1 is set to a position spaced at a predetermined distance (about 50 to 70 millimeters) to the full-close position Pc. In the case that the door panel 2*b* moves within a first moving range A1 from the full-open position Po to the first door position P1, the change amount of the electrostatic capacity in the sensor electrode 53 comes to an approximately fixed value if no foreign material lies between the door panel 2*b* and the vehicle body 2*a*. Accordingly, as shown in FIG. 8, in the case that the door panel 2*b* moves within the first moving range A1, the control circuit apparatus 8 sets the threshold value to a fixed value. In other words, the control circuit apparatus 8 sets a change rate of the threshold value to zero. The first door position P1 corresponds to a position at which the electrostatic capacity starts increasing between the sensor electrode 53 and the center pillar 2*d*, that is, a position of the door panel 2*b* at which the change amount of the electrostatic capacity in the sensor electrode 53 starts increasing, on the basis of the fact that the front end of the door panel 2*b* comes close to the center pillar 2*d*, as shown in FIG. 7.

Figure 8:
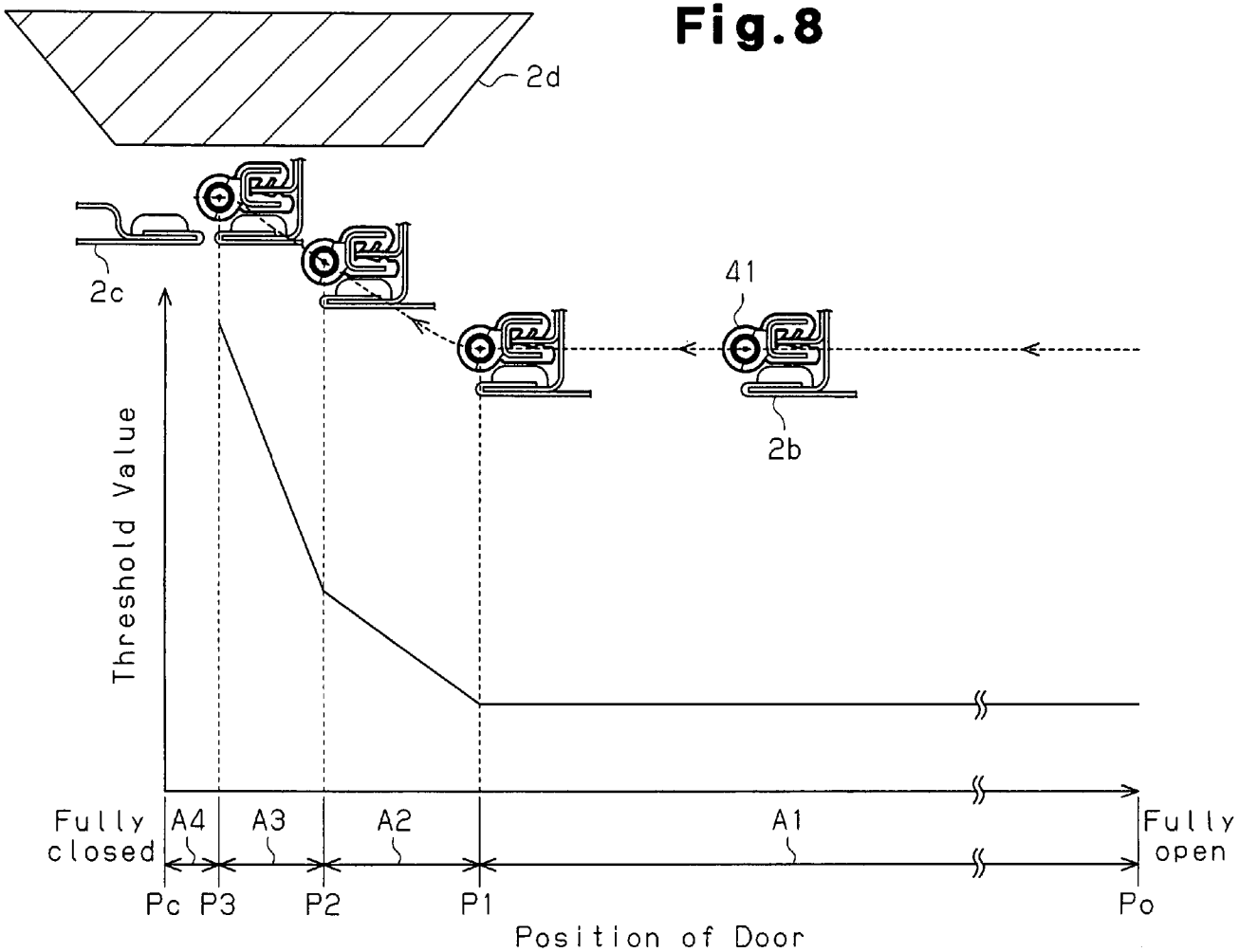
FIG. 8 is a graph showing a relation between the position of the door panel and a threshold value.

As shown in FIG. 8, if the door panel 2*b* is arranged at the first door position P1, the control circuit apparatus 8 changes the change rate of the threshold value. A second door position P2 is set between the first door position P1 and the full-close position Pc. Further, in the case that the door panel 2*b* moves within a second moving range A2 from the first door position P1 to the second door position P2, the control circuit apparatus 8 linearly enlarges the threshold value in accordance with the movement of the door panel 2*b* at the change rate changed at a time when the door panel 2*b* is arranged at the first door position P1.

In detail, the second door position P2 corresponds to a position at which the front end of the door panel 2*b* comes close to the door panel 2*c*, whereby the electrostatic capacity starts increasing between the sensor electrode 53 and the door panel 2*c*, that is, at a position of the door panel 2*b* at which the change amount of the electrostatic capacity in the sensor electrode 53 further starts increasing, as shown in FIG. 7. Further, in the second moving range A2, if no foreign material lies between the door panel 2*b* and the vehicle body 2*a*, the change amount of the electrostatic capacity in the sensor electrode 53 becomes larger in a curved manner by being affected by the approach of the sensor electrode 53 to the center pillar 2*d*.

Accordingly, the change rate of the threshold value changed at a time when the door panel 2*b* is arranged at the first door position P1 corresponds to a value changing the threshold value in the second moving range A2 so as to be positioned on a straight line extending along a curve expressing a relation between the position of the door panel 2*b* and the amount of change of the electrostatic capacity in the case that the door panel 2*b* moves in the second moving range A2. The threshold value in the second moving range A2 is larger than the amount of change of the electrostatic capacity in the sensor electrode 53 in the case that the door panel 2*b* moves in the second moving range A2 in a state in which no foreign material lies between the door panel 2*b* and the vehicle body 2*a*.

As shown in FIG. 8, if the door panel 2*b* is arranged at the second door position P2, the control circuit apparatus 8 changes the change rate of the threshold value. In detail, after the door panel 2*b* is arranged near the second door position P2, the amount of change of the electrostatic capacity in the sensor electrode 53 is affected by the movement of the sensor electrode 53 close to the door panel 2*c*, and becomes larger in a curved manner as the door panel 2*b* comes close to the full-close position Pc.

At this time, the change rate of the amount of change of the electrostatic capacity in the sensor electrode 53 is larger than the change rate of the amount of change of the electrostatic capacity in the sensor electrode 53 at a time when the door panel 2*b* moves within the second moving range A2. Accordingly, when the door panel 2*b* is arranged at the second door position P2, the control circuit apparatus 8 makes the change rate of the changed threshold value larger than the change rate of the threshold value in the second moving range A2. A third door position P3 is set between the second door position P2 and the full-close position Pc. Further, in the case that the door panel 2*b* moves within a third moving range A3 from the second door position P2 to the third door position P3, the control circuit apparatus 8 linearly enlarges the threshold value in accordance with the movement of the door panel 2*b* at the change rate changed at a time when the door panel 2*b* is arranged at the second door position P2.

The change rate of the threshold value changed at a time when the door panel 2*b* is arranged at the second door position P2 corresponds to a value changing the threshold value in the third moving range A3 so as to be positioned on a straight line extending along a curve expressing a relation between the position of the door panel 2*b* and the amount of change of the electrostatic capacity in the case that the door panel 2*b* moves in the third moving range A3. The threshold value in the third moving range A3 is larger than the amount of change of the electrostatic capacity in the sensor electrode 53 in the case that the door panel 2*b* moves in the third moving range A3 in a state in which no foreign material lies between the door panel 2*b* and the vehicle body 2*a*.

In the case that the door panel 2*b* moves in a fourth moving range A4 from the third door position P3 to the full-close position Pc, the control circuit apparatus 8 invalidates the electrostatic capacity detection signal input from the electrostatic capacity detecting apparatus 45. In the case that the door panel 2*b* exists within the fourth moving range A4, it is very unlikely that a foreign material is wedged between the door panel 2*b* and the vehicle body 2*a*.

Next, a description will be given of a motion of the motor-driven slide door apparatus 1 as a whole. If the open signal is input from the operating switch 31, the control circuit apparatus 8 outputs a drive signal for opening the door panel 2*b* to the slide motor 28 so as to drive the slide motor 28 in a direction of opening the door panel 2*b*. Further, when the drive force of the slide motor 28 is transmitted to the actuating mechanism 5, the door panel 2*b* is slid toward the full-open position. At this time, the control circuit apparatus 8 detects the position of the door panel 2*b* on the basis of the position detection signal input from the position detecting apparatus 24. Further, if it is detected that the door panel 2*b* is arranged at the full-open position, the control circuit apparatus 8 outputs a drive signal for stopping the door panel 2*b* to the slide motor 28 so as to stop the slide motor 28.

If the close signal is input from the operating switch 31, the control circuit apparatus 8 outputs a drive signal for closing the door panel 2*b* to the slide motor 28 so as to drive the slide motor 28 in a direction of closing the door panel 2*b*. At the same time, the control circuit apparatus 8 drives the foreign material detecting sensor 41. Further, when the driving force of the slide motor 28 is transmitted to the actuating mechanism 5, the door panel 2*b* is slid toward the full-close position.

At this time, if the current detection signal is input from the current detecting element 46, the control circuit apparatus 8 determines that a foreign material is wedged between the door panel 2*b* and the vehicle body 2*a*, on the basis of the input of the current detection signal. In other words, the control circuit apparatus 8 determines that a foreign material exists between the door panel 2*b* and the vehicle body 2*a*. Further, at this time, the control circuit apparatus 8 detects the amount of slide of the door panel 2*b*, that is, the position of the door panel 2*b* on the basis of the position detection signal input from the position detecting apparatus 24, and determines the threshold value on the basis of the detected position of the door panel 2*b*. In detail, as shown in FIG. 8, in the case that the door panel 2*b* moves within the first moving range A1, the control circuit apparatus 8 sets the threshold value to a fixed value.

If the control circuit apparatus 8 detects, on the basis of the position detection signal, that the door panel 2*b* is arranged at the first door position P1, the control circuit apparatus 8 changes the change rate of the threshold value. Further, in the case that the door panel 2*b* moves within the second moving range A2, the control circuit apparatus 8 linearly enlarges the threshold value as the door panel 2*b* comes close to the full-close position Pc, at the change rate changed at a time when the door panel 2*b* is arranged at the first door position P1.

If the control circuit apparatus 8 detects, on the basis of the position detection signal, that the door panel 2*b* is arranged at the second door position P2, the control circuit apparatus 8 changes the change rate of the threshold value. Further, in the case that the door panel 2*b* moves within the third moving range A3, the control circuit apparatus 8 linearly enlarges the threshold value as the door panel 2*b* comes close to the full-close position Pc, at the change rate changed at a time when the door panel 2*b* is arranged at the second door position P2.

Even in the case that the door panel 2*b* moves within any one of the first to third moving ranges A1 to A3, the control circuit apparatus 8 compares the change rate of the electrostatic capacity detected on the basis of the electrostatic capacity detection signal input from the electrostatic capacity detecting apparatus 45 with the threshold value. Further, in the case that the detected amount of change of the electrostatic capacity is larger than the threshold value, the control apparatus 8 determines that a foreign material exists between the door panel 2*b* and the vehicle body 2*a*. In the case that the door panel 2*b* moves within the fourth moving range A4, the control circuit apparatus 8 invalidates the electrostatic capacity detection signal input from the electrostatic capacity detecting apparatus 45. Further, the control circuit apparatus 8 validates only the current detection signal input from the current detecting element 46 and judges whether or not a foreign material exists between the door panel 2*b* and the vehicle body 2*a*.

Even in the case that the door panel 2*b* moves within any one of the first to fourth moving ranges A1 to A4, if the control circuit apparatus 8 determines that a foreign material exists between the door panel 2*b* and the vehicle body 2*a*, the control circuit apparatus 8 outputs a drive signal for moving the door panel 2*b* to the full-open position Po to the slide motor 28. If the drive signal is input, the slide motor 28 is driven in the direction of leaving open the door panel 2*b*, and the door panel 2*b* is slid to the full-open position Po.

In the case that it is determined that no foreign material exists between the door panel 2*b* and the vehicle body 2*a*, the control circuit apparatus 8 drives the slide motor 28 until the door panel 2*b* is arranged at the full-close position Pc. Further, if a half latch detection signal is input from the half latch detecting portion, the control circuit apparatus 8 outputs the drive signal to the closure motor 29. If the drive signal is input, the closure motor 29 actuates the lock mechanism, and moves the door panel 2*b* to a position where the lock can be executed by the lock mechanism. Further, if the control circuit apparatus 8 detects, on the basis of the position detection signal, that the door panel 2*b* is arranged at the full-close position Pc, the control circuit apparatus 8 outputs a drive signal for stopping the drive to the slide motor 28 and the closure motor 29 so as to stop the slide motor 28 and the closure motor 29.

As mentioned above, the present embodiment has the following operations and advantages.

(1) When the control circuit apparatus 8 detects that the door panel 2*b* is arranged at the first door position P1, and that the door panel 2*b* is arranged at the second door position P2 on the basis of the position detection signal, the control circuit apparatus 8 changes the change rate of the threshold value. In other words, the control circuit apparatus 8 changes the threshold value in accordance with the movement of the door panel 2*b* after the door panel 2*b* is arranged at the first door position P1. As mentioned above, since the threshold value is changed in accordance with the movement of the door panel 2*b*, it is possible to finely set a sensitivity for detecting a foreign material existing between the door panel 2*b* and the vehicle body 2*a*, in correspondence to the distance between the front end of the door panel 2*b* and the vehicle body 2*a* (the rear end of the door panel 2*c*, the center pillar 2*d* or the like). As a result, even if the electrostatic capacity is changed between the vehicle body 2*a* and the sensor electrode 53 during the closing motion of the door panel 2*b*, the change rate of the threshold value is changed in correspondence to the position of the door panel 2*b*, whereby it is possible to prevent the control circuit apparatus 8 from determining the center pillar 2*d* and the door panel 2*c* as foreign materials. In other words, even in the case that the door panel 2*b* moves in the region (the second moving region A2 and the third moving region A3) at which the electrostatic capacity is changed between the center pillar 2*d* and the door panel 2*c*, and the sensor electrode 53, during the closing motion of the door panel 2*b*, it is possible to detect a foreign material existing between the door panel 2*b* and the vehicle body 2*a* in a non-contact manner. Accordingly, it is possible to widen the range at which a foreign material between the door panel 2*b* and the vehicle body 2*a* can be detected in a non-contact manner within the moving range of the door panel 2*b*.

(2) The vehicle body 2*a* and the door panel 2*b* have various shapes in correspondence to vehicle types. Accordingly, since the front end of the door panel 2*b* comes close to the center pillar 2*d* and the door panel 2*c* during the closing motion of the door panel 2*b*, the position of the door panel 2*b* at which the electrostatic capacity starts changing between the center pillar 2*d* and the door panel 2*c*, and the sensor electrode 53 is subtly different in accordance with the vehicle types. Further, a change way of the electrostatic capacity in accordance with the movement of the door panel 2*b* is different in accordance with the vehicle types, between the center pillar 2*d* and the door panel 2*c*, and the sensor electrode 53. In the meanwhile, in accordance with the present embodiment, if the door panel 2*b* comes close to the full-close position Pc during the closing motion of the door panel 2*b*, the amount of change of the electrostatic capacity in the sensor electrode 53 is enlarged by the movement of the door panel 2*b* closer to the center pillar 2*d* and the door panel 2*c*. Further, if the control circuit apparatus 8 detects that the door panel 2*b* is arranged at the first door position P1 corresponding to the position of the door panel 2*b* at which the amount of change of the electrostatic capacity in the sensor electrode 53 starts increasing, on the basis of the movement of the front end of the door panel 2*b* close to the center pillar 2*d*, the control circuit apparatus 8 changes the change rate of the threshold value. Further, if the control circuit apparatus 8 detects that the door panel 2*b* is arranged at the second door position P2 corresponding to the position of the door panel 2*b* at which the amount of change of the electrostatic capacity in the sensor electrode 53 starts further increasing, on the basis of the movement of the front end of the door panel 2*b* close to the door panel 2*c*, the control circuit apparatus 8 changes the change rate of the threshold value. As mentioned above, since the control circuit apparatus 8 changes the change rated of the threshold value in correspondence to the distance between the center pillar 2*d* and the door panel 2*c*, and the door panel 2*b* mainly affecting the amount of change of the electrostatic capacity in the sensor electrode 53, it is possible to prevent the existence of a foreign material from being erroneously detected in correspondence to the vehicle body 2*a* and the door panel 2*b*.

(3) After the door panel 2*b* is arranged at the first door position P1, the control circuit apparatus 8 changes the change rate of the threshold value in correspondence to the position of the door panel 2*b*. Accordingly, it is possible to easily change the threshold value in accordance with the movement of the door panel 2*b*.

(4) When the control circuit apparatus 8 detects that the door panel 2*b* is arranged at the first door position P1, and that the door panel 2*b* is arranged at the second door position P2 on the basis of the position detection signal, the control circuit apparatus 8 changes the change rate of the threshold value. Accordingly, it is possible to set the threshold value to the value in correspondence to the change of the electrostatic capacity in accordance with the movement of the door panel 2*b* between the center pillar 2*d* and the door panel 2*c*, and the sensor electrode 53, in comparison with the case that the change rate of the threshold value is changed only one time during the period when the door panel 2*b* reaches the full-close position Pc from the first door position P1. Accordingly, it is possible to reduce a dispersion of the sensitivity for detecting a foreign material between the door panel 2*b* and the vehicle body 2*a*. Further, since the control circuit apparatus 8 executes the change of the change ratio of the threshold value only two times, it is possible to simplify the control executed by the control circuit apparatus 8 in comparison with the case that the change rate of the threshold value is changed three times or more.

(5) The control circuit apparatus 8 changes the change rate of the threshold value in such a manner that the change rate of the threshold value becomes larger as the door panel 2*b* comes close to the full-close position Pc. In general, in the case that the door panel 2*b* is moved toward the full-close position Pc from the full-open position Po, if the door panel 2*b* reaches the predetermined position, the amount of change of the electrostatic capacity between the vehicle body 2*a* and the sensor electrode 53 is thereafter enlarged in such a curved manner that the change rate is enlarged step by step, as the door panel 2*b* comes close to the full-close position Pc. Accordingly, if the change rate of the threshold value is changed in such a manner that the value becomes larger as the door panel 2*b* comes close to the full-close position Pc, it is possible to set the threshold value to the value corresponding to the amount of change of the electrostatic capacity changing in accordance with the movement of the door panel 2*b* between the vehicle body 2*a* and the sensor electrode 53. As a result, it is possible to further reduce the dispersion of the sensitivity for detecting a foreign material between the door panel 2*b* and the vehicle body 2*a*.

(6) The change rate of the threshold value is set in correspondence to the amount of change (refer to FIG. 7) of the electrostatic capacity actually detected by the sensor electrode 53 previously in the state in which no foreign material exists between the door panel 2*b* and the vehicle body 2*a* at a time of the closing motion of the door panel 2*b*. Accordingly, it is possible to more reliably set the threshold value in correspondence to the shape of the front end of the door panel 2*b* and the shape of the vehicle body 2*a*.

(7) The sensor main body 44 is provided in the front end of the door panel 2*b*, that is, the end portion positioned in the front side in the forward moving direction of the door panel 2*b* at a time of the closing motion. Accordingly, in the case that a foreign material exists at the position closer to the front end of the door panel 2*b* during the closing motion between the front end of the door panel 2*b* and the rear end of the door panel 2*c*, it is possible to more early detect the existence of a foreign material, for example, than the case that the sensor main body 44 is provided in the rear end of the door panel 2*c*.

The embodiment in accordance with the present invention may be changed as follows.

In the embodiment mentioned above, the sensor main body 44 is arranged in the front end of the door panel 2*b* of the motor-driven slide door apparatus 1. However, the sensor main body 44 may be fixed to the peripheral edge of the door opening 9 facing the front end of the door panel 2*b*, that is, the rear end of the door panel 2*c*.

Figure 9:
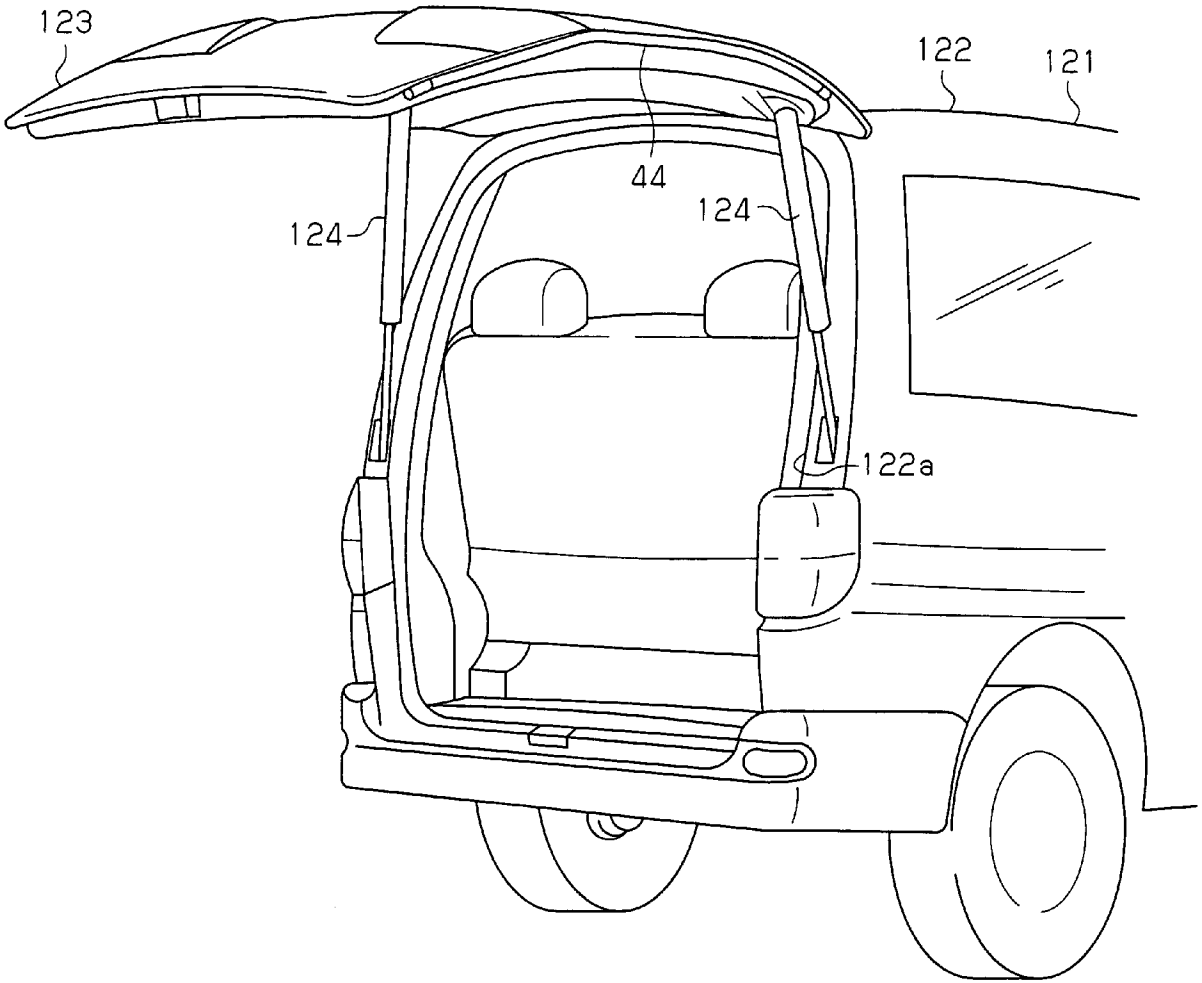
FIG. 9 is a perspective view showing a part of a vehicle in which a foreign material detecting sensor in accordance with a first modified embodiment is arranged.

Further, the sensor main body 44 may be provided in a flip-up backdoor 123 provided in a rear portion of a vehicle body 122 of a vehicle 121, as shown in FIG. 9. In detail, a sensor main body 44 is fixed to each of both end portions of the backdoor 123 in the width of the vehicle. Each sensor main body 44 faces a peripheral edge of an opening portion 122*a* provided in the vehicle body. Even in this case, since the control circuit apparatus 8 changes the threshold value in correspondence to the position of the backdoor 123, it is possible to obtain the same operations and advantages as those of the embodiment mentioned above. Further, in the vehicle 121 shown in FIG. 9, the sensor main body 44 may be fixed to a peripheral edge of the opening portion 122*a* facing the backdoor 123, or may be fixed to the peripheral edge of the opening portion 122*a* facing a damper 124 for opening and closing the backdoor 123. The sensor main body 44 may be fixed to a peripheral edge of a trunk positioned in a front side in a forward moving direction at a time of the closing motion, in a door of the trunk opened and closed by an electric motor, or may be fixed to a peripheral edge of an opening portion of the vehicle body opened and closed by the door of the trunk.

In the embodiment mentioned above, the control circuit apparatus 8 changes the change rate of the threshold value in such a manner that the change rate of the threshold value becomes larger as the door panel 2*b* comes close to the full-close position Pc. However, the control circuit apparatus 8 may change the change rate of the threshold value in correspondence to the position of the door panel 2*b*, for example, in such a manner as to alternately repeat the moving range in which the change rate of the threshold value is set in such a manner that the threshold value becomes larger step by step in accordance with the movement of the door panel 2*b* to the full-close position Pc, and the moving range in which the change rate of the threshold value is set to 0.

In the embodiment mentioned above, when the control circuit apparatus 8 detects that the door panel 2*b* is arranged at the first door position P1, and that the door panel 2*b* is arranged at the second door position P2 on the basis of the position detection signal, the control circuit apparatus 8 changes the change rate of the threshold value. However, the control circuit apparatus 8 may change the change rate of the threshold value only at a time of detecting that the door panel 2*b* is arranged at the first door position P1. In accordance with this structure, it is possible to make the control executed by the control circuit apparatus 8 more simple in comparison with the case that the change of the change rate of the threshold value is executed two times.

The control circuit apparatus 8 may change the change rate of the threshold value three times or more after detecting that the door panel 2*b* is arranged at the first door position P1. In accordance with this structure, it is possible to set the threshold value to the value corresponding to the amount of change of the electrostatic capacity between the vehicle body 2*a* (the door panel 2*c* and the center pillar 2*d* or the like) and the sensor electrode 53 in accordance with the movement of the door panel 2*b*, in comparison with the case that the change rate of the threshold value is changed two times during the period when the door panel 2*b* reaches the full-close position Pc from the first door position P1. Accordingly, it is possible to reduce the dispersion of the sensitivity for detecting a foreign material between the door panel 2*b* and the vehicle body 2*a*.

The control circuit apparatus 8 may continuously change the change rate of the threshold value as the door panel 2*b* comes close to the full-close position Pc, after detecting that the door panel 2*b* is arranged at the first door position P1. In this case, the threshold value is changed in a curved manner, after the door panel 2*b* is arranged at the first door position P1. As mentioned above, if the change rate of the threshold value is continuously changed by the control circuit apparatus 8, it is possible to set the threshold value to the value corresponding to the amount of change of the electrostatic capacity between the vehicle body 2*a* and the sensor electrode 53 in accordance with the movement of the door panel 2*b*, in comparison with the case that the change rate is changed a number of times during the period when the door panel 2*b* reaches the full-close position Pc from the first door position P1. Therefore, it is possible to further lower the dispersion of the sensitivity for detecting a foreign material between the door panel 2*b* and the vehicle body 2*a*.

In the embodiment mentioned above, the control circuit apparatus 8 detects the amount of change of the electrostatic capacity in the sensor electrode 53 on the basis of the electrostatic capacity detection signal. However, the control circuit apparatus 8 may detect the electrostatic capacity (the detected value) in the sensor electrode 53 on the basis of the electrostatic-capacity detection signal. In this case, the control circuit apparatus 8 changes the change rate of the threshold value in correspondence to the position of the door panel 2*b* during the closing motion, and the electrostatic capacity actually detected by the sensor electrode 53, in the case that no foreign material lies between the door panel 2*b* and the vehicle body 2*a*. In this structure, it is possible to obtain the same operations and advantages as those of the embodiment mentioned above.

Figure 10:
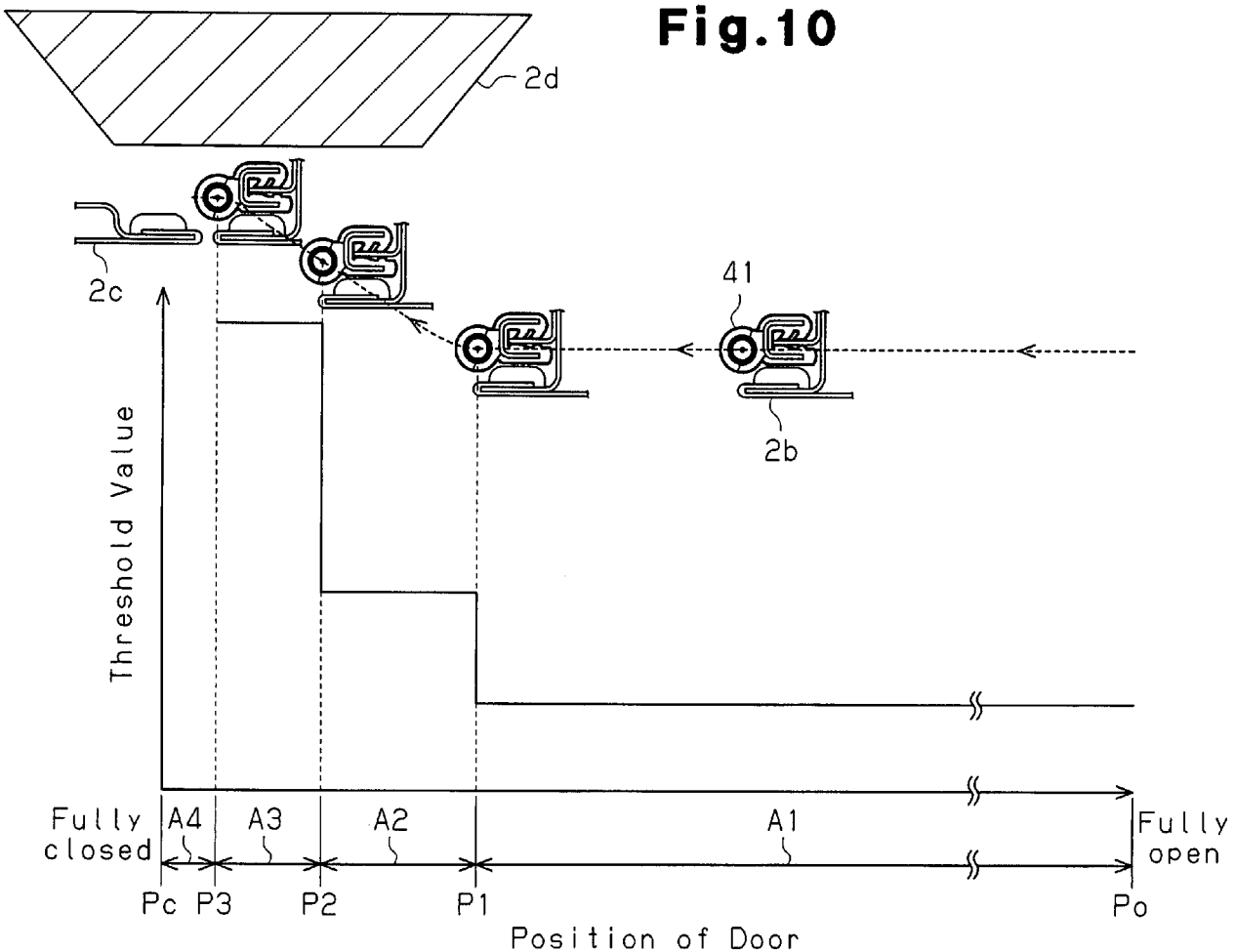
FIG. 10 is a graph showing a relation between a position of a door panel and a threshold value in accordance with a second modified embodiment.

In the embodiment mentioned above, when the control circuit apparatus 8 detects, on the basis of the position detection signal, that the door panel 2*b* is arranged at the first door position P1, the control circuit apparatus 8 changes the change rate of the threshold value, thereby continuously changing the threshold value in accordance with the movement of the door panel 2*b*. However, the control circuit apparatus 8 may change the threshold value in stages in correspondence to the position of the door panel 2*b*, as shown in FIG. 10. In an example shown in FIG. 10, if the control circuit apparatus 8 detects, on the basis of the position detection signal, that the door panel 2*b* is arranged at the first door position P1, at a time of the closing motion of the door panel 2*b*, the control circuit apparatus 8 changes the threshold value to a larger value than the threshold value in the first moving range A1. Further, in the case that the door panel 2*b* moves within the second moving range A2, the control circuit apparatus 8 judges on the basis of the threshold value changed at a time when the door panel 2*b* is arranged at the first door position P1 whether or not a foreign material exists between the door panel 2*b* and the vehicle body 2*a*. The control circuit apparatus 8 detects, on the basis of the position detection signal, that the door panel 2*b* is arranged at the second door position P2, the control circuit apparatus 8 changes the threshold value to the value larger than the threshold value in the second moving range A2. Further, in the case that the door panel 2*b* moves within the third moving range A3, the control circuit apparatus 8 judges whether or not foreign material exists between the door panel 2*b* and the vehicle body 2*a*, by using the threshold value changed at a time when the door panel 2*b* is arranged at the second door position P2.

Figure 11:
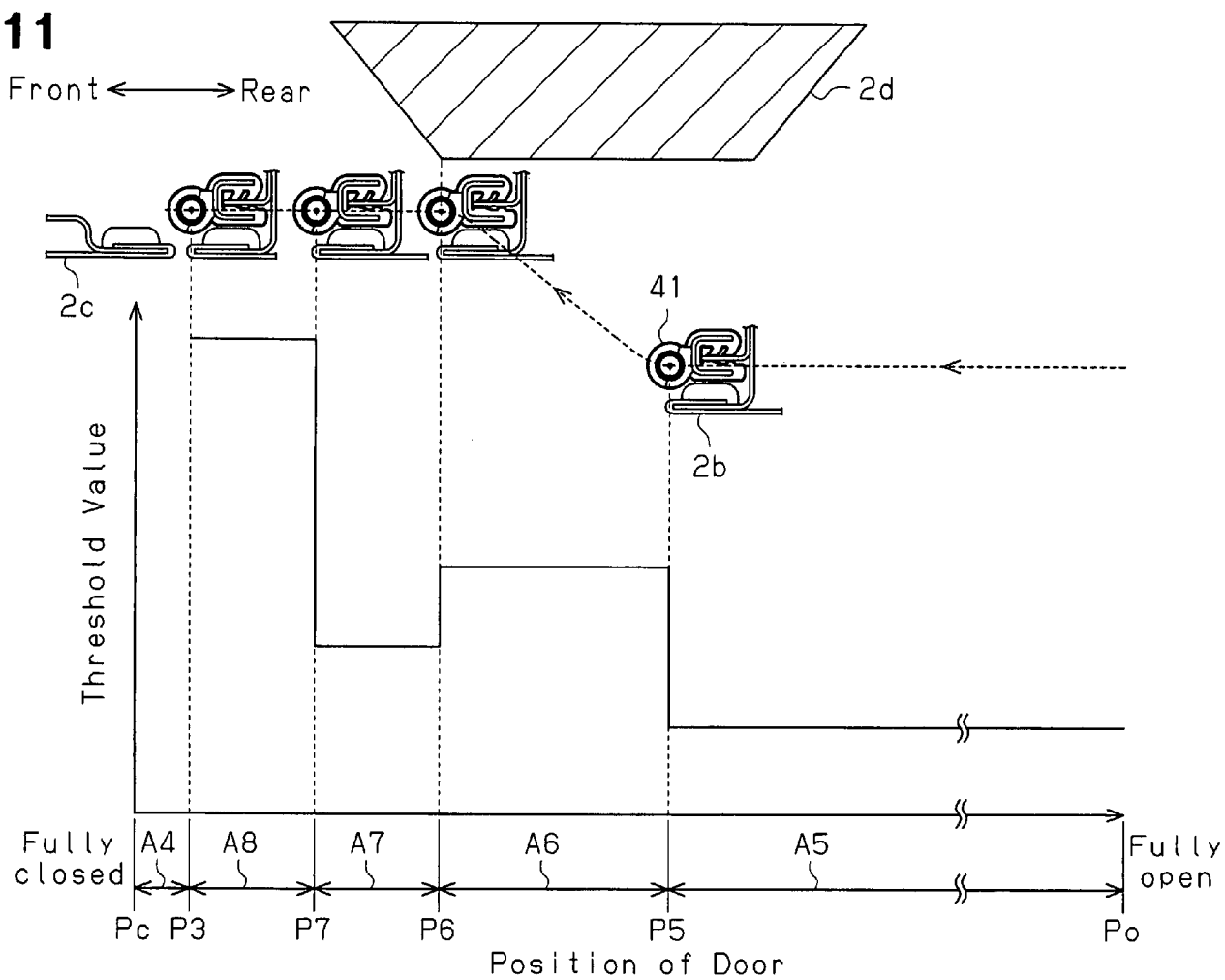
FIG. 11 is a graph showing a relation between a position of a door panel and a threshold value in accordance with a third modified embodiment.

In the case that the center pillar 2*d* is arranged in a rear side of the vehicle than the rear end of the door panel 2*c*, the control circuit apparatus 8 may change the threshold value in stages in correspondence to the position of the door panel 2*b*, as shown in FIG. 11. In an example shown in FIG. 11, if the control circuit apparatus 8 detects that the door panel 2*b* is arranged, at a fifth door position P5 set between the full-open position Po and the full-close position Pc, a sixth door position P6 set between the fifth door position P5 and the full-close position Pc, and a seventh door position P7 set between the sixth door position P6 and the full-close position Pc, the control circuit apparatus 8 changes the threshold value.

The fifth door position P5 corresponds to a position at which the electrostatic capacity starts increasing between the sensor electrode 53 and the center pillar 2*d* on the basis of the movement of the front end of the door panel close to the center pillar 2*d*, that is, a position of the door panel 2*b* at which the amount of change of the electrostatic capacity in the sensor electrode 53 starts increasing. The sixth door position P6 corresponds to a position at which the electrostatic capacity between the sensor electrode 53 and the center pillar 2*d* starts reducing on the basis of the movement of the front end of the door panel 2*b* away from the center pillar 2*d*. The seventh door position P7 corresponds to a position at which the electrostatic capacity starts increasing between the sensor electrode 53 and the door panel 2*c* on the basis of the movement of the front end of the door panel 2*b* close to the door panel 2*c*, that is, a position of the door panel 2*b* at which the amount of change of the electrostatic capacity in the sensor electrode 53 starts increasing. In FIG. 11, a range from the full-open position Po to the fifth door position P5 is set to a fifth moving range A5, and a range from the fifth door position P5 to the sixth door position P6 is set to a sixth moving range A6. Further, a range from the sixth door position P6 to the seventh door position P7 is set to a seventh moving range A7, and a range from the seventh door position P7 to the same third door position P3 as that of the embodiment mentioned above is set to an eighth moving range A8.

If the control circuit apparatus 8 detects, on the basis of the position detection signal, that the door panel 2*b* is arranged at the fifth door position P5, at a time of the closing motion of the door panel 2*b*, the control circuit apparatus 8 changes the threshold value to a larger value than the threshold value in the fifth moving range A5. Further, in the case that the door panel 2*b* moves within the sixth moving range A6, the control circuit apparatus 8 compares the threshold value changed at a time when the door panel 2*b* is arranged at the fifth door position P5, with the amount of change of the electrostatic capacity detected on the basis of the electrostatic detection signal, and judges on the basis of the result of comparison whether or not a foreign material exists between the door panel 2*b* and the vehicle body 2*a*.

If the control circuit apparatus 8 detects, on the basis of the position detection signal, that the door panel 2*b* is arranged at the sixth door position P6, the control circuit apparatus 8 changes the threshold value to a value smaller than the threshold value in the sixth moving range A6, and larger than the threshold value in the fifth moving range A5. The threshold value is changed as mentioned above, because the sensor electrode 53 moves away from the center pillar 2*d* and the amount of change of the electrostatic capacity starts reducing in the sensor electrode 53, if the door panel 2*b* passes the sixth door position P6. In the case that the door panel 2*b* moves within the seventh moving range A7, the control circuit apparatus 8 compares the threshold value changed at a time when the door panel 2*b* is arranged at the sixth door position P6, with the amount of change of the electrostatic capacity detected on the basis of the electrostatic capacity detection signal, and judges on the basis of the result of comparison whether or not a foreign material exists between the door panel 2*b* and the vehicle body 2*a*.

If the control circuit apparatus 8 detects that the door panel 2*b* is arranged at the seventh door position P7 on the basis of the position detection signal, the control circuit apparatus 8 changes the threshold value to the larger value than the threshold value in the sixth moving range A6. As mentioned above, the threshold value is changed because the amount of change of the electrostatic capacity in the sensor electrode 53 starts increasing on the basis of the movement of the sensor electrode 53 close to the door panel 2*c*, in the case that the door panel 2*b* passes the seventh door position P7. In the case that the door panel 2*b* moves within the eighth moving range A8, the control circuit apparatus 8 compares the threshold value changed at a time when the door panel 2*b* is arranged at the seventh position P7, with the amount of change of the electrostatic capacity detected on the basis of the electrostatic capacity detection signal, and judges on the basis of the result of comparison whether or not a foreign material exists between the door panel 2*b* and the vehicle body 2*a*.

As in the examples shown in FIGS. 10 and 11, if the control circuit apparatus 8 is structured such that the threshold value is changed in stages on the basis of the position detection signal, it is easy to set the threshold value changed by the control circuit apparatus 8, in comparison with the case that the threshold value is linearly and continuously changed such as the embodiment mentioned above, and the case that the threshold value is continuously changed in a curved manner. If the threshold value is changed a number of times as shown in FIG. 11, it is possible to set the threshold value to the value corresponding to the amount of change of the electrostatic capacity between the vehicle body 2*a* and the sensor electrode 53 in accordance with the movement of the door panel 2*b*, in comparison with the case that the threshold value is changed only one time during the period when the door panel 2*b* reaches the full-close position Pc from the fifth door position P5. Accordingly, it is possible to further lower the dispersion of the sensitivity for detecting a foreign material between the door panel 2*b* and the vehicle body 2*a*. On the other hand, if the threshold value is changed as shown in FIG. 10, the control circuit apparatus 8 executes the change of the threshold value only two times. Accordingly, it is possible to simplify the control executed by the control circuit apparatus 8 in comparison with the case that the threshold value is changed three times or more.

The invention claimed is:

1. An opening and closing apparatus comprising:

a fixed body;

an opening portion formed in said fixed body and having a peripheral edge;

a movable body movable between a full-close position covering said opening portion and a full-open position not covering said opening portion, the movable body also movable to a first change position placed between the full-open position and full-close position, wherein the movable body includes a front side, a rear side, a top side, and a bottom side, the front side being the side of the movable body positioned closest to the peripheral edge and wherein the front side of the movable body and the peripheral edge contact each other when the movable body is in the full-close position;

a detecting sensor, said detecting sensor having a sensor electrode provided on at least one end portion of the movable body, the at least one end portion positioned at the front side of the movable body, and wherein the detecting sensor outputs an electrostatic capacity detection signal in correspondence to a change of an electrostatic capacity between said sensor electrode and a conductive foreign material moving close to the sensor electrode;

a judging portion adapted to judge whether or not a foreign material exists between said movable body and the peripheral edge of said opening portion by comparing a threshold value with a detection value determined from the electrostatic capacity detection signal;

a position detecting portion adapted to output a position detection signal corresponding to a position of said movable body;

a threshold value change portion adapted to begin to change said threshold value on the basis of said position detection signal when the signal indicates that said movable body is positioned at the first change position as said movable body is being moved towards the full-close position, wherein a change in the threshold value over time defines a change rate of the threshold value, and wherein said threshold value change portion alters the change rate when said movable body reaches the first change position as the movable body is being moved towards the full-close position.

2. The opening and closing apparatus according to claim 1, wherein, in the case of detecting, on the basis of said position detection signal, that said movable body is arranged at said first change position, said threshold value change portion changes the change rate of said threshold value a number of times until said movable body reaches said full-close position.

3. The opening and closing apparatus according to claim 2, further comprising a second change position previously set between said first change position and said full-close position, wherein, in the case of detecting that said movable body is arranged at said first change position and in the case of detecting that said movable body is arranged at said second change position on the basis of said position detection signal, said threshold value change portion changes the change rate of said threshold value.

4. The opening and closing apparatus according to claim 1, wherein, in the case of detecting, on the basis of said position detection signal, that said movable body is arranged at said first change position, said threshold value change portion continuously changes the change rate of said threshold value over time in relation to a position of the movable body relative to the full-close position as said movable body moves from the first change position to the full-close position.

5. The opening and closing apparatus according to claim 1, wherein said threshold value change portion changes the change rate of said threshold value in such a manner that the change rate of said threshold value becomes larger as said movable body comes close to said full-close position.

6. The opening and closing apparatus according to claim 1, wherein the change rate of said threshold value changed by said threshold value change portion is set to correspond to an actual change of said electrostatic capacity previously detected by said sensor electrode in a state in which no foreign material exists between said movable body and the peripheral edge of said opening portion at a time of a closing motion of said movable body.

7. The opening and closing apparatus according to claim 1, wherein, in the case of detecting, on the basis of said position detection signal, that said movable body is arranged at said first change position, said threshold value change portion changes said threshold value in stages on the basis of said position detection signal.

8. The opening and closing apparatus according to claim 7, wherein, in the case of detecting, on the basis of said position detection signal, that said movable body is changed to said first change position, said threshold value change portion changes said threshold value a number of times until said movable body reaches said full-close position.

9. The opening and closing apparatus according to claim 8, further comprising a second change position previously set between said first change position and said full-close position, wherein, in the case of detecting that said movable body is arranged at said first change position and in the case of detecting that said movable body is arranged at said second change position on the basis of said position detection signal, said threshold value change portion changes said threshold value.

10. The opening and closing apparatus according to claim 1, wherein said fixed body is constituted by a body of a vehicle, said opening portion is formed in a side portion of said vehicle, and said movable body is constituted by a door panel slid along a fore-and-aft direction of said vehicle so as to open and close said opening portion.

11. The opening and closing apparatus according to claim 1, wherein said fixed body is constituted by a body of a vehicle, said vehicle has a rear portion, said opening portion is formed in the rear portion of said vehicle, and said movable body is constituted by a flip-up backdoor provided in the rear portion of said vehicle so as to open and close said opening portion.

* * * * *